United States Patent [19]

Gustafsson

[11] 4,046,310

[45] Sept. 6, 1977

[54] CONTAINER

[75] Inventor: Nils-Ake Gustafsson, Halmstad, Sweden

[73] Assignee: Sprinter Pack AB, Halmstad, Sweden

[21] Appl. No.: 695,978

[22] Filed: June 14, 1976

[30] Foreign Application Priority Data

June 17, 1975 Sweden ..... 7506938

[51] Int. Cl.[2] ..... B65D 5/56; B65D 5/20

[52] U.S. Cl. ..... 229/30; 206/519; 229/14 BL

[58] Field of Search ..... 229/30, 14 BL; 206/519

[56] References Cited

U.S. PATENT DOCUMENTS

| | | | |
|---|---|---|---|
| 1,937,402 | 11/1933 | Cherry | 206/519 |
| 2,814,427 | 11/1957 | Emery | 206/519 |
| 3,288,340 | 11/1966 | Shapiro et al. | 206/519 |
| 3,539,552 | 11/1970 | Mounts et al. | 206/519 |
| 3,756,495 | 9/1973 | Bemiss | 206/519 |
| 3,981,401 | 9/1976 | Blanchard | 206/519 |

FOREIGN PATENT DOCUMENTS

| | | | |
|---|---|---|---|
| 219,326 | 12/1958 | Australia | 206/519 |

*Primary Examiner*—Davis T. Moorhead

*Attorney, Agent, or Firm*—Ostrolenk, Faber, Gerb & Soffen

[57] ABSTRACT

A nestable, stackable container comprised of a tray preferably erected from carton blank and having cut-away portions defined at the ends thereof, a tray of plastic film is formed within the carton tray through a deep drawn process in which the upper end of the film tray is folded over the upper edge of the carton tray. The film tray is extended outwardly through the cut-away end portions to form a pair of stacking lips which serve to prevent nested containers from becoming wedged into one another.

5 Claims, 4 Drawing Figures

CONTAINER

BACKGROUND OF THE INVENTION

This invention relates to a container consisting of a generally conically shaped tray or carton provided with a tray of plastic film which is in contact with the inside of the carton tray, said plastic tray having been deep drawn into the carton tray and extending around the upper edge of the carton tray and downwardly a short distance along its external surface.

Containers of this type are generally used in packing margarine, marmalade etc., and are typically filled at a place other than where the containers are manufactured, requiring that the containers to be transported and stored be stacked in each other to reduce space requirements. When the containers are to be separated from each other for filling it is not unusual that two or more containers get stuck in each other and in the case of big stack heights it can also occur that the containers situated at the very bottom are jammed together and in some cases have to be disposed of. These containers therefore have been provided with different types of support - or stacking lips inside or outside the container in order to prevent wedging of the contaiers when stacked into each other in a nesting fashion. These stacking lips are generally formed from the plastic tray situated in the carton tray either at the upper or lower portion of the container. In the containers having their stacking lips provided at the upper portion, the stacking lips can be formed from either the flange of the plastic tray bent over the upper edge of the carton tray, said lip extending around the opening of the container being in contact with the outside of the carton tray, or the stacking lips can be formed as support lips which are pressed out from the plastic tray at the corners of the container.

Now it has appeared that the known containers described above have certain disadvantages. The fact is that the number of support lips pressed out from the plastic tray influence the inner volume of the container. For different reasons, the container has to be totally filled so that no air remains in the finished product. The outer size of the container is also of great importance, and therefore stacking lips provided outside do prejudice the space the containers occupy often packed in large numbers.

BRIEF DESCRIPTION OF THE INVENTION

The disadvantages mentioned above are overcome by the present invention which has the object of providing a container of the type set forth above, wherein the carton tray comprises cut-out portions at the upper edge of its end walls through which cut-away portions pressed out of material from said plastic tray projects beyond the outer periphery of the carton tray and forms support surfaces for a container situated below in telescopingly stacking a number of nestable containers.

The present invention provides a container which in a remarkable way fulfills the object, but is at the same time still simple and inexpensive to manufacture. Thanks to the end walls of the carton tray which comprise an end flap folded up from its bottom, said end flap resting against wall sections bent inwardly from the side walls of the carton tray, a container having surprisingly good stiffness is obtained especially in the upper edge section of the end walls. This is absolutely necessary if stacking lips would at all be placed in this region, as the flexibility or elasticity of an end wall constructed in the usual way is so large that if stacking lips are formed in the upper central portion of the end walls they would not be able to fulfil the function intended. In constructions known before, one has been forced to locate the stacking lips at the corner sections of the container.

BRIEF DESCRIPTION OF THE FIGURES

The invention will now be described by way of example with particular reference to the accompanying drawings wherein.

DETAILED DESCRIPTION OF THE INVENTION

Figure 1:
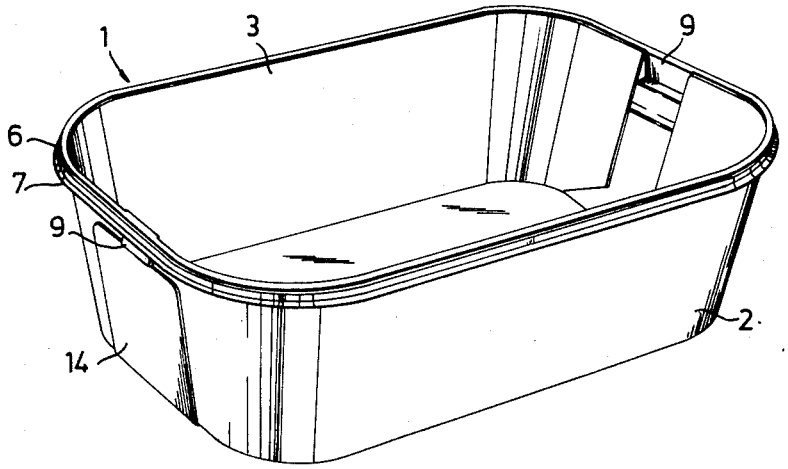
FIG. 1 shows a perspective view of the container according to the present invention.
Figure 3:
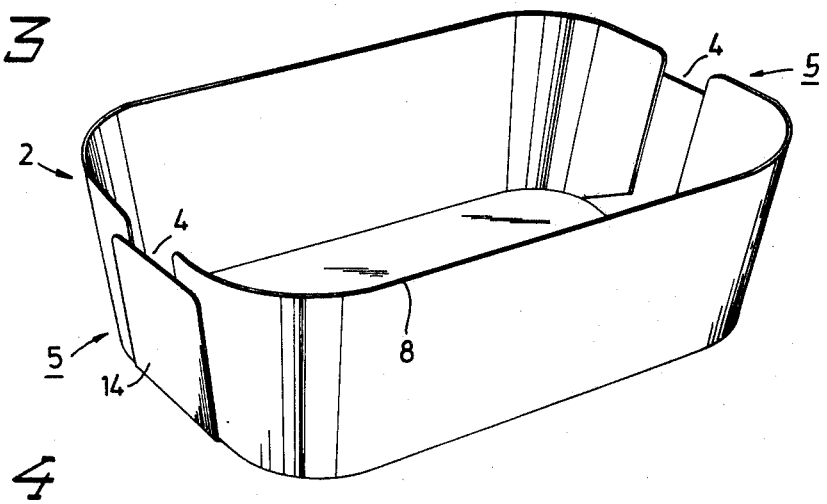
FIG. 3 shows a perspective view of the erected carton tray having cut-away portions in both end walls according to the invention.

A container 1 according to the invention illustrated in FIG. 1 consists of a generally conical-shaped carton tray 2 and a tray 3 formed of plastic film and being in contact with the interior surface of the carton tray 2. In manufacturing the container 1 the carton tray 2 is placed in a mould, whereupon the carton tray 2, in turn, is used as a mold for hot forming of a plastic film to a plastic film tray 3 inside the carton tray 2. During the deep drawing of the plastic film into the carton tray 2, which occurs by aid of pressure and/or vacuum, the film is pressed out through recesses or cut-away portions 4 in the end walls 5 of the carton tray 2 (see FIG. 3). Said cut-away portions 4 are obtained automatically in erecting the carton tray 2. The plastic film tray 3 has an integrally formed edge 6, which extends around the upper edge 8 (FIG. 3) of the carton tray 2 and a short distance downwards along the exterior of the tray 2 and terminates in a flange 7 extending outwardly and downwardly. The edge 6 and its flange 7 are provided to cooperate with a lid, etc., not illustrated in the drawings. The cut-away portions 4, which are located in the upper edge 8 of the end walls 5, receive material pressed out from the plastic film tray 3 to provide stacking lips 9, said lips being comprised of a support surface 10 directed downwardly towards a container (not shown) situated below container 1 in stacking a number of nestable containers 1 into each other.

Figure 2:
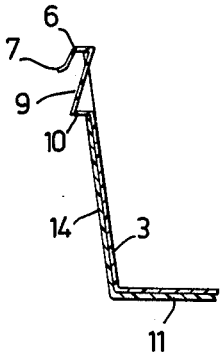
FIG. 2 shows a vertical section through the central portion of the end wall of the container illustrated in FIG. 1.
Figure 4:
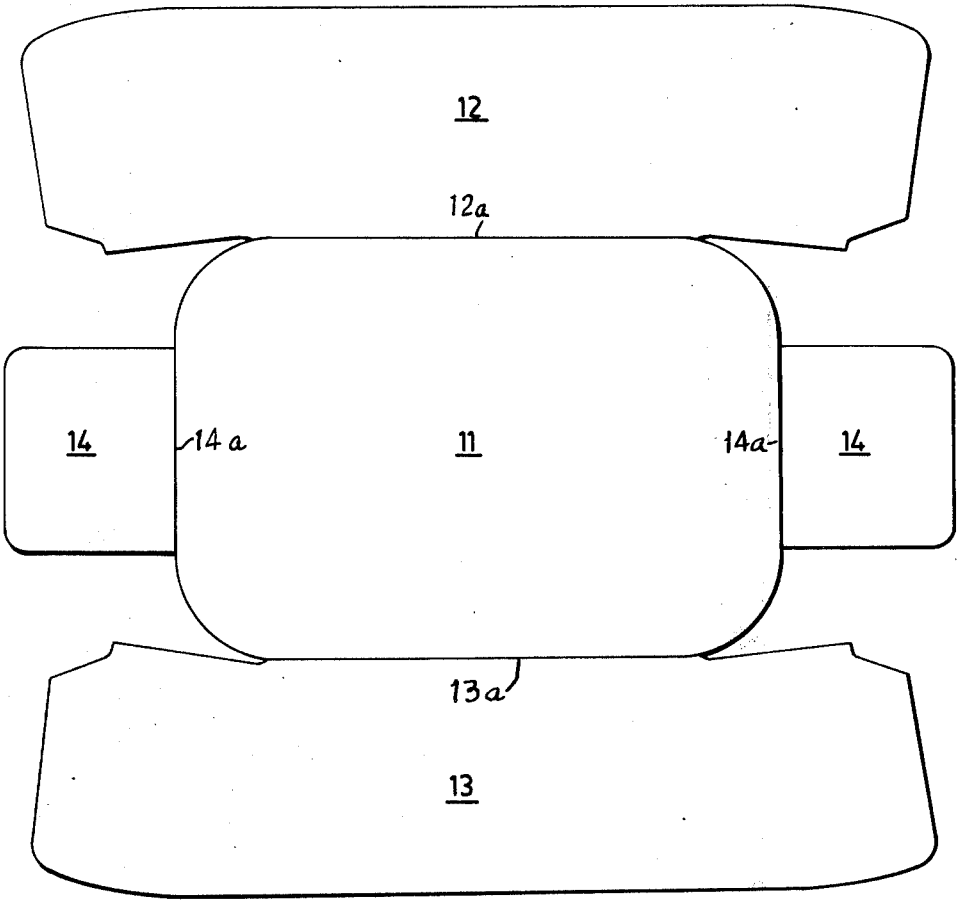
FIG. 4 shows a plan view of the blank of the carton tray illustrated in FIG. 3.

From FIG. 2, showing a cross-section through an end wall 5 of the container 1 illustrated in FIG. 1, it can be seen how the stacking lip 9 projects outwardly and has its support surface 10 resting against the upper edge of an end flap 14 folded up from the bottom 11 of the carton tray 2. The lip continues upwardly and inwardly to form the edge 6, and then outwardly and downwardly to terminate in the edge of flange 7. The blank illustrated in FIG. 4 comprises a bottom 11 and two opposite long side walls 12 and 13, which are folded up and bent inwardly along fold lines **12*a* and 13*a*, with the end portions bent towards each other to form the side walls of the tray as well as parts of its end walls. End flaps 14, 14 are folded upwardly along fold lines 14*a*, 14*a* towards the bent in ends of the side walls 12, 13 in order to span the ends of the side walls 12, 13 and said flaps 14** can, for example, be fixed to the sidewalls by a suitable adhesive, thereby forming the finished container 1 illustrated in FIG. 1. The height of the end flaps 14 is less than the height of the side walls 12, 13, and therefore no cutting away of the flat carton blank is necessary in order to provide the cut-away portions 4. Owing to this, a carton blank is provided which has a shorter length in its longitudinal direction, resulting in a significant saving of material in the stamping blanks of carton. The finished container 1 has inclined walls which facilitate the stacking of the nestable containers into one another.

The invention is not restricted to the embodiment described above and illustrated in the drawings, but this embodiment merely comprises an example of the invention and its applications.

What is claimed is:

1. A nestable, stackable container comprising a generally conical-shaped tray (2) of a carton provided with a tray (3) of plastic film which is in contact with the interior of the carton tray (2), said plastic tray (3) being deep drawn into the carton tray (2) and extending over and around the upper edge (8) of the carton tray (2) and a short distance downwardly along the exterior of the carton tray (2), characterized in that each end wall (5) of the carton tray (2) comprises a centrally situated cut-away portion (4) at the upper edge (8) of said end walls (5), through which portions of material from said plastic tray (3) are pressed outwardly so as to extend beyond the exterior of the carton tray (2) and thereby form a stacking lip (9), said stacking lip (9) being adapted to engage the upper edge (8) of a like container (1) situated there-below when stacking a number of such containers (1) such that a space is provided between the bottom walls (11) of adjacent containers to thereby prevent the container from becoming wedged or jammed when nested into another container.

2. A container according to claim 1, characterized in that the sides of the cut-away portion (4) are defined by side walls (12, 13) folded up from the bottom (11) of the carton tray (2) at the longer sides of the bottom and bent inwardly and towards the middle of the end walls (4) and the lower edge of the cut-away portion (4) is defined by the free edge of an end flap (14), folded upwardly from the end of the bottom (11), of the tray (2) and resting against the inwardly folded side walls (12, 13), said end flap (14), together with the side walls (12, 13) being folded to engage one another, thereby cooperatively forming the container.

3. A container according to claim 2, characterized in that the end flaps (14) of the carton tray blank (2) each have a height which is less than the height of the side walls (12, 13) when the tray is in the erected position.

4. A nestable, stackable container comprising:

a generally conical-shaped carton tray (2) including a base (11) having side edges (12*a*, 13*a*) and end edges (14*a*), a pair of side walls (12, 13) extending from said side edges, and a pair of end flaps (14) extending from said end edges, said side walls having extensions which form, in conjunction with said edge flaps, the end walls of said container, the length and height of said end flaps and said side walls being adapted to form a centrally situated cut-away portion adjacent the upper edge of each side wall when said carton blank is formed into said carton tray (2);

a tray (3) of plastic film which is deep drawn into said carton tray (2) and which extends over and around the upper edge (8) of the carton tray (2) and a short distance downwardly along the exterior of said carton tray (2), portions of material from said plastic tray (3) being pressed outwardly through said cut-away portions (4) so as to extend beyond the exterior of said carton tray (2) and thereby form a stacking lip (9).

5. A nestable stacking container according to claim 4 wherein the height of said end flaps is less than the height of said side walls and the total length of said end walls is less than the combined length of said base (11) and said end flaps (14).

* * * * *